United States Patent [19]

Baugh

[11] 3,952,763

[45] Apr. 27, 1976

[54] SEQUENCE CONTROL VALVE

[75] Inventor: Benton F. Baugh, Houston, Tex.

[73] Assignee: Vetco Offshore Industries, Inc.

[22] Filed: Apr. 29, 1974

[21] Appl. No.: 464,771

[52] U.S. Cl. ..... 137/119; 137/106; 137/625.11

[51] Int. Cl.[2] ..... B15B 13/06

[58] Field of Search ..... 91/413, 420; 137/102, 137/106, 118, 119, 624.14, 624.18, 624.2, 624.27, 625.11, 625.66; 251/297

[56] References Cited

UNITED STATES PATENTS

| | | | |
|---|---|---|---|
| 1,936,504 | 11/1933 | Fostér et al. | 137/118 X |
| 2,208,682 | 7/1940 | O'Brien | 137/119 X |
| 2,311,108 | 2/1943 | Hauser | 137/624.2 |
| 2,844,942 | 7/1958 | Reynolds | 137/624.27 X |
| 2,932,319 | 4/1960 | Reinecke | 137/624.2 |
| 3,162,210 | 12/1964 | Bemis | 137/625.11 X |
| 3,331,384 | 7/1967 | Moore | 137/119 |
| 3,386,471 | 6/1968 | King | 91/420 X |
| 3,500,719 | 3/1970 | Rieschel | 137/624.14 X |
| 3,641,880 | 2/1972 | Honeycutt | 91/420 |
| 3,741,182 | 6/1973 | Wade et al. | 137/119 X |

FOREIGN PATENTS OR APPLICATIONS

| | | | |
|---|---|---|---|
| 764,407 | 5/1934 | France | 251/297 |
| 932,849 | 9/1955 | Germany | 251/297 |

*Primary Examiner*—Alan Cohan
*Assistant Examiner*—Gerald Michalsky
*Attorney, Agent, or Firm*—Pravel & Wilson

[57] ABSTRACT

A control valve providing various predesignated output signals in response to changes in the pressure of a fluid input signal including a position responsive member mounted for operative connection with such fluid input signal for movement to various positions to direct the fluid input signal outwardly as a selective output signal.

16 Claims, 6 Drawing Figures

SEQUENCE CONTROL VALVE

BACKGROUND OF THE INVENTION

The field of this invention is control valves for providing selective output signals in response to limited input signals to control the operation of an underwater christmas tree or the like.

Presently subsea oil well completions are generally accomplished by mounting on the wellhead a christmas tree having a valve network that is operable from the surface of several different types of systems, such systems being mounted with the christmas tree and extending to a control center at the surface. One such control system in use is an electrohydraulic control system which, although rather sophisticated, is very expensive. Another control system utilizes separate control lines for operating each of the separate valve functions associated with the subsea christmas tree but, the number of control lines needed renders this system very expensive as well as cumbersome.

SUMMARY OF THE INVENTION

It is an object of this invention to provide a new and improved system for controlling the operation of an underwater christmas tree or the like from the water surface by utilizing a fluid input signal at selectively varied pressures. The system and apparatus of the preferred embodiment of this invention includes a housing mounted with the christmas tree or the like and connected to a remote fluid input signal source which can be mounted at the water surface, the input signal source being capable of providing fluid input signals at selectively varied pressures.

A position responsive means is mounted in the housing for operative condition with an output signal means for movement between various positions in response to selective variations in the pressure of the fluid input signal.

The output signal means is mounted with the housing and cooperates with the position responsive means to direct the variable fluid input signal into a predesignated output signal in response to the position of the position responsive means, which is determined by the pressure of the fluid input signal. In this manner, a remote fluid input signal is utilized to provide various predesignated output signals in response to variation in the pressure intensity of the input signal source.

The position responsive means of the preferred embodiment of this invention further includes a position responsive element which is movable between various signalling positions in response to changes in the pressure of the fluid input signal. Yieldable means are mounted with the position responsive element in order to control the position of the element and resist changes in such position except for changes responding to predesignated changes in the pressure level of the fluid input signal. The position responsive element includes passageways therein which may be aligned with output flow modes mounted in the output signal means whereby a particular output signal mode can be produced in response to a predesignated variation in the fluid pressure level of the fluid input signal.

DESCRIPTION OF THE PREFERRED EMBODIMENT

Figure 1:
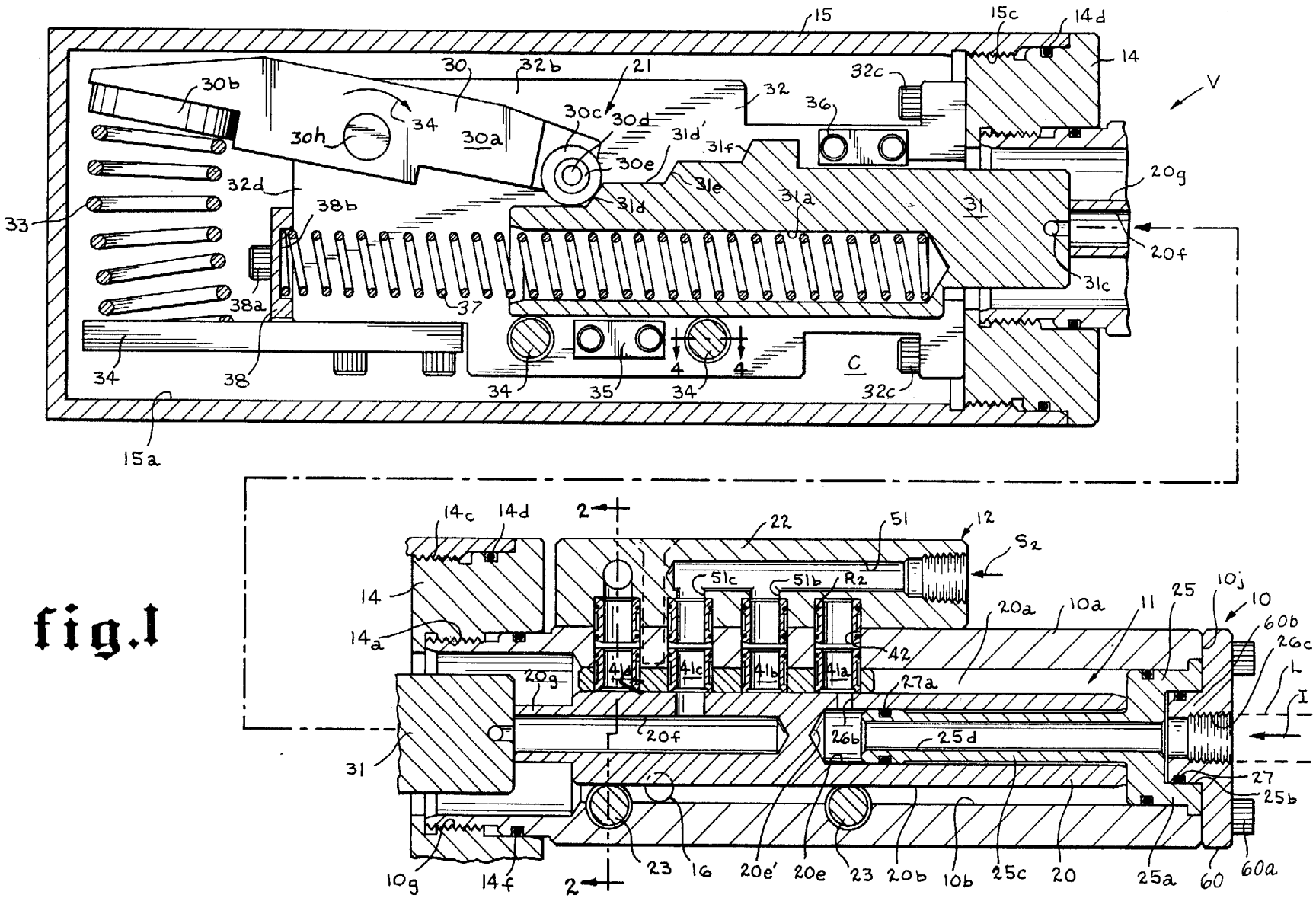
FIG. 1 is a view in section of the control valve of the preferred embodiment of this invention with the actuator element or gate member in a position for providing a first output signal.

Referring to the drawings and in particular FIG. 1, the letter V generally designates the control valve of the preferred embodiment of this invention which is adapted to be mounted with a christmas tree (not shown) or the like located on an underwater well for the purpose of operating such christmas tree by varying input fluid pressure signals I provided by an input signal line schematically deesignated as L which may extend to the water surface. The control valve V basically includes a housing generally designated as 10 adapted for mounting with the underwater christmas tree and further adapted for connection to an input signal source (not shown) through input signal line L. In the embodiment of the invention described herein, a christmas tree will be considered representative of a type of valving system which can be controlled by the control valve V of this invention. Further, the input signal source (not shown) will be consistently described as being a source located above water and attached to the input signal line L, which extends from the surface of the water to the underwater christmas tree. It should be understood that the christmas tree and the location of the input signal source are only representative of the types of systems which can be operated and controlled utilizing the control valve V. For example, a valving system which can be controlled by the control valve V is practically any system which requires one or more operating signals at various times. Regarding the input signal source, it is obviously remote when located at the surface of a body of water and connected through an input signal line L to an underwater christmas tree. However, it should be understood that the input signal source can be located at any point with respect to the actual control valve V and utilized to operate same.

The control valve V further includes a position responsive means generally designated as 11 which is mounted in the housing 10 for operative connection with an output signal means generally designated as 12. The output signal means is mounted with the housing 10 and cooperates with the position responsive means 11 to receive fluid input signals I from the fluid input line L and directs such fluid input signals into predesignated output signals in response to the position of the position responsive means 11, which is controlled by the pressure level of the fluid in the fluid input line L.

Figure 5:
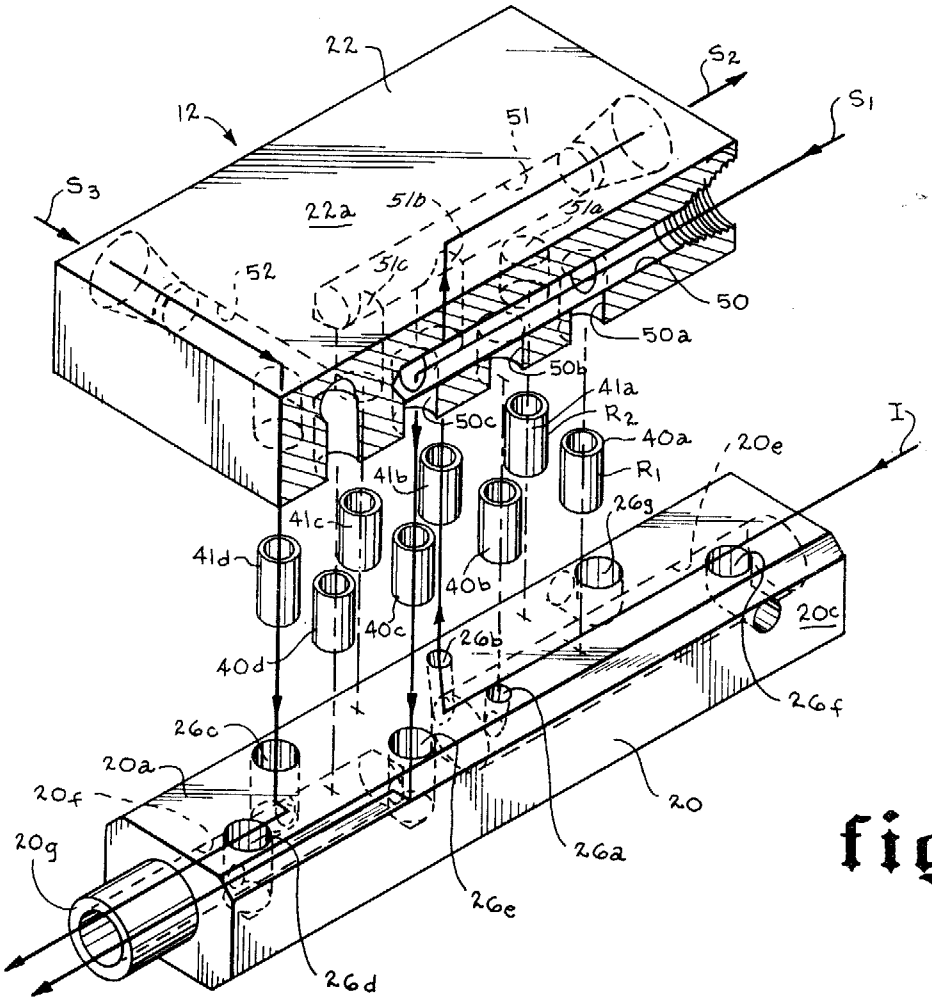
FIG. 5 is a schematic view of the relative position between the signalling elements of the control valve producing a second output signal in response to a particular input signal pressure.
Figure 6:
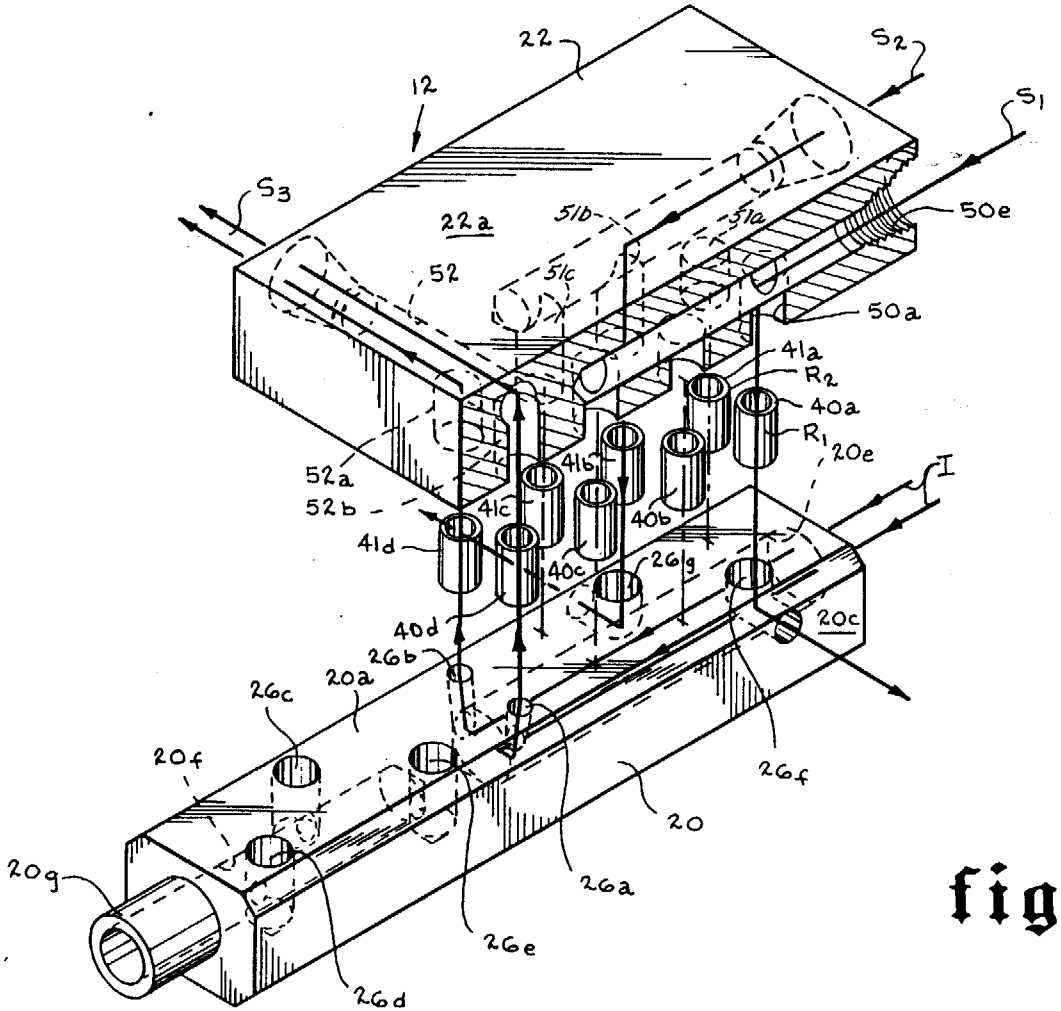
FIG. 6 is a schematic view similar to FIG. 5 except that the signalling elements are in a different position than FIG. 5 in order to produce a third output signal in response to a different input signal.

In the embodiment of the invention described, the output signal means 12 is capable of providing output signals S1, S2, S1+S2 and S3 which are schematically illustrated throughout the drawings and in FIGS. 5 and 6 in particular. These output signals S1, S2, S1+S2 and S3 are connected to valves or other devices on the christmas tree which are operated by means of pressure signals. In the embodiment of the invention illustrated herein, the signals S1, S2, and S3 are utilized individually and in combination in connection with various valves and valve systems on a christmas tree to control such valves and valve systems in response to variations in fluid pressure in the input fluid line L. For the purposes of description, the signal provided in fluid input line L has been designated as an input fluid signal I and is subject to predesignated pressure variations as controlled at the input signal source (not shown) in a manner well known in the art.

Figure 2:
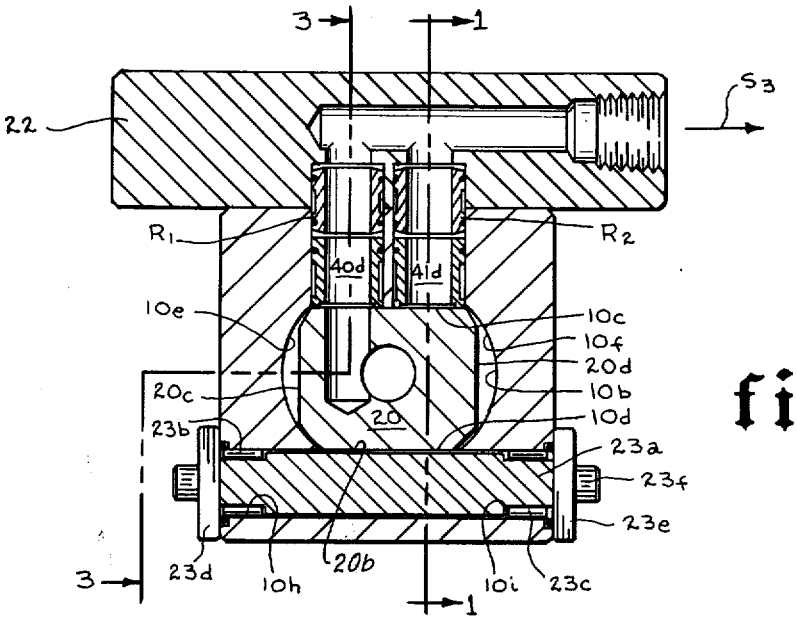
FIG. 2 is a sectional view taken along line 2—2 of FIG. 1 illustrating one of the output signal modes or paths utilized.

The housing 10 includes a signal housing section 10*a* which is generally square in the sectional view of FIG. 2. The signal housing section 10*a* includes a bore 10*b* which extends throughout its length. The bore 10*b* is basically a truncated sphere as viewed in FIG. 2 and includes upper surface 10*c* and lower surface 10*d* and curved, side surfaces or walls 10*e* and 10*f*. The signal housing section 10*a* has a threaded end section 10*g* which receives a housing connecting ring 14. The housing connecting ring 14 includes an inner, threaded cylindrical bore 14*a* which mounts over threaded housing end portion 10*g* in threaded engagement therewith. A suitable O-ring is provided at 14*f* to provide a sealed, threaded connection between the connecting ring 14 and the signal housing section 10*a*. The housing connecting ring 14 includes an annular, outer threaded portion 14*c* which receives a cam assembly housing designated by the number 15. The cam assembly housing 15 is rectangular in the sectional view of FIG. 1 and includes a hollow, bore 15*a*. The cam assembly housing 15 is threaded at inner end portion 15*b* for threaded engagement with the outer, annular threaded connector ring portion 14*c*. A suitable O-ring seal 14*d* is mounted in the annular outer threaded connector ring portion 14 to provide a sealed connection between the cam assembly housing 15 and the connecting ring 14. Thus the housing, which has been generally designated as 10, includes three basic sections or portions: the signal housing section 10*a*, the housing connecting ring 14 and the cam assembly housing 15 which are threadedly and sealably interconnected. Further, the bore 10*b* in the signal housing section 10*a* is opened to the cam assembly housing bore 15*a* through the inner, annular threaded opening 14*a* in the housing connecting ring 14 thus forming an entire, combination housing chamber which may be designated by the letter C. The chamber C is vented by means of vent port 16 which is illustrated schematically in FIG. 1 and actually extends through the wall of the signal housing section 10*a*. The vent port 16 may have any suitable vent or exhaust line (not shown) connected therewith in order to vent fluid within the housing chamber C outwardly thereof.

The position responsive means 11 includes an actuator or gate member 20 and a cam means generally designated as 21 mounted in the housing chamber C for directing the fluid input signal I along predesignated paths within the control valve V in response to the particular pressure level of the fluid input signal I. The output signal means 12 includes two rows generally designated as R1 and R2 of intermediate or connecting ports mounted in the signal housing section 10*a*. The output signal means 12 further includes a manifold assembly 22 mounted onto the signal housing section 10*a* in particular alignment with the rows R1 and R2 of connecting ports. The particular structure of both the rows R1 and R2 of connector ports and the manifold assembly 22 will be described hereinafter; however, it can be said that the rows R1 and R2 of connector ports and the manifold assembly 22 cooperate with the gate member 20 and the position cam means 21 to receive the fluid input signal I and direct such fluid input signal outwardly through the manifold assembly 22 in order to provide any one of four signals S1, S2, S1+S2 or S3.

The gate member 20 in the embodiment illustrated herein has the general shape of an elongated block which is generally rectangular in the sectional view of FIG. 1 and generally square in the sectional view of FIG. 2. The gate member 20 may be made of any suitable material; in the preferred embodiment of this invention the gate member 20 is a high strength, corrosion resistant alloy steel. The gate member 20 may be defined as having an upper, flat surface 20*a*, a lower flat surface 20*b*, and sides 20*c* and 20*d*. Referring in particular to FIG. 2, the corners of the gate member 20 are beveled to better conform the gate member to the curved side walls 10*f* in the bore 10*b* of the signal housing section 10*a*. The gate member 20 is mounted in the signal housing section 10*a* for slidable movement between various positions by spaced axle assemblies 23. Each of the axle assemblies 23 are identical and, referring to FIG. 2, include an axle member 23*a* mounted in signal housing openings 10*h* and 10 *i*. The axle member 23*a* is supported for rotation by needle bearings 23*b* and 23*c* positioned in the signal housing openings 10*h* and 10*i*, respectively. Retainer plates 23*d* and 23*e* are mounted over the housing openings 10*h* and 10*i* in order to retain the axle members 23*a* in position to support the gate member 20 for slidable movement within the signal housing section 10*a*. The retainer plates may be attached to the signal housing section 10*a* by any suitable means such as bolts 23*f*.

A signal sub 25 is mounted in the signal housing 10 and extends into gate member bore 20*e*. The signal sub 25 includes a base 25*a* positioned on one end of the signal housing section 10*a* by means of a retainer end plate 60, which is bolted by bolts 60*a* into the end face 10*j* of the signal housing section 10*a*. The signal sub base 25*a* includes a counterbore 25*b* which receives hub portion 60*b* of the end retainer plate 26. O-ring seal 27 is mounted in the retainer hub portion in order to prevent the passage of fluids between the signal sub 25 and the retainer end plate 26. The signal sub further includes a tubular support portion or mandrel 25*c* which is formed integrally with the base portion 25*a* and extends laterally into the bore 20*e* of the gate member 20. The mandrel portion 25*c* of the signal sub has a bore 25*d* therein which is open to the counter bore 25*b* in the signal sub base 25*a*. The end retainer plate 26 has a bore or passageway 26*c* therein which is aligned with the mandrel bore 25*d*. The end retainer plate bore 26*c* is partially threaded to make a threaded connection with the signal input line L, which has been previously described as being illustrated schematically in FIG. 1. An O-ring 27*a* is mounted over the tubular mandrel support portion 25*c* and sealably engages the gate member bore 20*e*.

The gate member 20 further includes an exhaust bore 20*f* which is separated from the signal receiving bore 20*e* and extends laterally to the gate member rear end 20*g*, which is a protruding, tubular portion formed integrally with the remainder of the gate member 20.

Input signal ports 26*a* and 26*b* are machined in the gate member 20 and are open to the input signal bore 20*e* and the upper face 20*a* of the gate member 20. The position of the gate member 20 within the signal housing section bore 10*b* is such that the input signal bore 26*a* is aligned with row R1 of the connector ports and input signal port 26*b* is aligned with row R2 of the connector ports.

Exhaust ports 26*c*, 26*d* and 26*e* are machined in the gate member 20 to open to the exhaust bore 20*f* and the upper face 20*a* of the gate member 20. Exhaust port 26*c* is aligned with row R2 of the connector ports and exhaust ports 26*d* and 26*e* are aligned with row R1 of the connector ports. Additionally, chamber exhaust ports 26*f* and 26*g* are machined in the gate member 20 adjacent to, but not in fluid communication with, the input signal bore 20*e*. The chamber exhaust ports 26*f* and 26*g* are substantially L-shaped and open to the upper gate member face 20*a* and to gate member sides 20*c* and 20*d*, respectively. Chamber exhaust port 26*f* is aligned with row R1 of the connector ports and chamber exhaust port 26*g* is aligned with row R2 of the connector ports.

The position cam means 21 is mounted within the cam housing section 15 in continuous engagement with the gate member 20 in order to control the position of the gate member 20 in response to the pressure of the fluid input signal I. The position cam means 21 includes a cam follower assembly 30 which yieldably engages a detent slide member 31, both of which are supported by internal housing support 32. The internal housing support 32 includes side support plates 32*a* and 32*b* which are bolted onto the housing connector ring 14 by bolts 32*c* or other suitable means.

The cam follower assembly 30 includes a pivot arm 30*a* which is supported by shaft member 32*c* on side support plate 32*b* for pivotal movement. One end of the pivot arm 30*a* includes an annular rim portion 30*b* which is adapted to receive a detent spring 33, the detent spring 33 being supported by an additional support base 34 which is bolted onto the end portion such as 32*d* of the side support plates 32*a* and 32*b*. The detent spring 33 acts to continually urge the pivot arm 30*a* toward clockwise movement in the direction of arrow 34. The pivot arm 30*a* has a cam follower or roller 30*c* mounted at the other or forward end thereof. The cam follower 30*c* is mounted onto the pivot arm 30*a* by means of a shaft 30*d* which is supported on the pivot arm by suitable means. A bearing assembly 30*e* is utilized to mount the cam follower 30*c* for relatively friction free rotation.

The cam follower 30*c* mounted on the pivot arm 30*a* is continually urged into yieldable engagement with the detent slide 31 by the detent spring 33. The detent slide 31 is mounted onto spaced axle assemblies 34 between the internal support side plates 32*a* and 32*b* for slidable movement within the entire housing chamber C. The internal, side support plates 32*a* and 32*b* are interconnected by a bottom or lower bolt assembly 35 which extends between the slide plates 32*a* and 32*b* and further by an upper or top bolt assembly 36 which extends between the side plates. The detent slide 31 is positioned between these upper and lower bolt assemblies 35 and 36 which interconnect the internal support side plates 32*a* and 32*b*; the detent member 31 is actually supported on the axle assemblies 34 for slidable movement.

The axle assemblies 34 each include axle members 34*a* mounted in openings 34*b* and 34*c* in the internal support side plates 32*a* and 32*b*, respectively. The axle members 34 are mounted for rotation by means of needle bearings 34*d* positioned in such openings 34*b* and 34*c*. In this manner, the detent slide 31 is supported for slidable movement within the cam housing 15.

The detent slide 31 includes an internal bore portion 31*a* which receives a position return spring 37. The position return spring 37 is a coil spring which is mounted onto an end plate 38 which is positioned by bolt 38*a* onto the ends such as 32*d* of the internal support plates 32. The spring end plate 38 includes a recess 38*b* which receives and supports the position return spring 37 in lateral alignment with the detent slide bore 31*a*. The position return spring 37 continually urges the detent slide member 31 into engagement with the protruding end portion 20*g* of the gate member 20 and further urges both the detent slide 31 and the gate member 20 toward the initial or first position for the gate members illustrated in FIG. 1.

The detent slide member 31 includes exhaust passageways 31*c* which allow fluid to pass outwardly from the gate member exhaust bore 20*f* into the housing chamber C and outwardly through vent port 16.

The slide member 31 includes three inclined, detent shoulders 31*d*, 31*e* and 31*f* which can be engaged by the cam follower 30*c*. Each of the laterally spaced, detent shoulders 31*d*, 31*e* and 31*f* cooperate with the spring loaded cam follower 30*c* to determine the position of both the slide member 31 and more importantly the position of the gate member 20.

The gate member 20 is movable to four controlled positions in response to the pressure level of the fluid input signal I in cooperation with the detent slide member 31, the cam follower assembly 30 and the position return spring 37. These four positions will be further identified in greater detail later.

Each row R1 and R2 of connector ports or passageways include four such ports. The connector ports in row R1 are designated as 40*a*, 40*b*, 40*c* and 40*d*. The ports in row R2 are designated as 41*a*, 41*b*, 41*c* and 41*d*. The particular structure of each of the ports 41*a*–40*d* and 41*a*–41*d* is identical except for position, the relative position of each of the ports being schematically illustrated in total in FIGS. 5 and 6.

Each of the connector ports 40*a*–40*d* and 41*a*–41*d* are formed in a group of eight circular openings collectively designated by the number 42 in the signal housing section 10*a*. Each of the ports 40*a*–40*d* and 41*a*–41*d* are identical except for position and are formed of an upper seal sub 43 and a lower shear seal 44. The upper seal sub 43 is a cylindrical, metal ring mounted in the openings 42 in sealed engagement therewith by means of O-ring seals. Lower shear seals 44 are cylindrical, metal rings positioned in the openings 42 below the seal sub 43. Each shear seal is made of a extremely hard, corrosion resistant metal. Each shear seal has mounted therewith an O-ring for sealably engaging the circular wall of the openings 42. In addition, the bottom face 44*a* of each shear seal 44 is milled or otherwise machined to a very fine finish for engaging the gate member upper surface 20*a*, which is also finely finished, so as to prevent the entry of any particles into the ports 40*a*–40*d* and 41*a*–41*d*. A flow restriction plate 45 is positioned between the upper signal housing bore surface 10*c* and the upper gate member surface 20*a* about the shear seals 44 for supporting such shear seals in position. The flow restriction plate 45 includes a series of openings 45*a* which are substantially aligned with the openings 42 in the signal housing section 10*a* and adapted to receive each of the shear seals 44. The flow restriction plate 45 acts to restrict the flow of fluid through ports 26*a* and 26*b* when the gate member is between positions.

The output signal means 12 is mounted onto the signal housing section 10*a* for receiving the fluid input signal I through the gate member 20 and through the connector port rows R1 and R2 and directing such fluid input signal I outwardly to provide output signals S1, S2, S1+S2 or S3. The output signal means 12 includes a manifold assembly 22 provided in part by a manifold block 22*a* mounted over the seal subs 43 of the connector ports 40*a*–40*d* and 41*a*–41*d* in engagement with the signal housing section 10*a*. The manifold block 22*a* may be secured by any suitable means such as bolts (not shown). The manifold block 22*a* includes a lateral bore 50 for producing output signal S1. The lateral bore 50 is aligned with three vertical bore portions 50*a*, 50*b* and 50*c*. The vertical bore portions 50*a* and 50*c* fit over the seal subs 43 of connector ports 40*a* and 40*c* and open to the lateral bore 50. The vertical bore portion 50*b* fits over the seal sub 43 for the connector port 40*b* but does not open to the vertical bore portion 50. The vertical bore 50 includes threaded end portion 50*e* for receiving a suitable coupling to place the fluid output signal S1 emitted from the lateral bore 50 in fluid signalling communication with any desired ultimate function, which may be some type of valve or other device on a christmas tree or other valve system which can be actuated and/or de-actuated by the fluid output signal S1.

A lateral bore 51 is machined in the manifold block 22*a* substantially parallel to the lateral bore 50 for delivering the fluid output signal S2. Vertical bore portions 51*a*, 51*b* and 51*c* are aligned with the lateral bore 51 and are spaced to mount over the seal subs 43 of connector ports 41*a*, 41*b* and 41*c*, respectively. The vertical bore portions 51*b* and 51*c* open to the lateral bore 51; however, the vertical bore portion 51*a* is closed to the lateral bore 51.

Lateral bore 52 is machined in the manifold block 22*a* in a direction substantially perpendicular to the direction of the lateral bore 50 and 51. The vertical bore 52 is adapted to receive the fluid input signal I at particular pressures and directs such fluid input signal I outwardly to provide fluid output signal S3. The lateral bore 52 is open to two vertical portions 52*a* and 52*b* which mount over the seal subs 43 for connector ports 41*d* and 40*d*, respectively.

Therefore, the vertical bore portions 50*a*–50*c*, 51*a*–51*c* and 52*a* and 52*b* of the manifold block 12*a* mount over the seal subs 43 for the connector ports 40*a*–40*d* and 41*a*–41*d* in order to provide selective fluid communication with the gate member 20. The vertical bore portions 50*a*–50*c* and 52*b* mount over the seal subs 43 of the connector ports 40*a*–40*d* of row R1. And, the vertical bore portions 51*a*–51*c* and 52*a* mount over the seal subs for the connector ports 41*a*–41*d* of row R2. The lateral bore 51 providing signal S2 and the lateral bore 52 providing signal S3 are also threaded at their outer ends similarly to lateral bore 50 in order to provide a fluid communication with ultimate functions such as valves which may be actuated and/or de-actuated by the fluid output signals S2 and S3. In addition, the lateral bores 50 and 51 are also connected to a common line (not shown) such that a combined fluid output signal S1+S2 can be utilized to also direct an ultimate function so that the control valve V can be utilized to direct four ultimate functions such as valves or other operators with three fluid output signals.

OPERATION AND USE

The control valve V of this invention is capable of converting a single fluid input signal I into four different output signals S1, S2, S1+S2 and S3 in response to changes in the pressure level of the fluid input signal. In the embodiment of the invention described herein, the control valve V is used with a subsea christmas tree for controlling various valves (ultimate functions) from the water surface. Thus, although not shown, the lateral bores 50, 51 and 52 are connected by suitable fluid lines to at least four different valves so that at least four different valves can be operated by the four different signals S1, S2, S1+S2 or S3 which can be provided in response to changes in the pressure level of the fluid input signal I. The actual production of each of these four signals S1, S2, S1+S2 and S3 in response to changes in the pressure level of the fluid input signal I will now be described.

Figure 3:
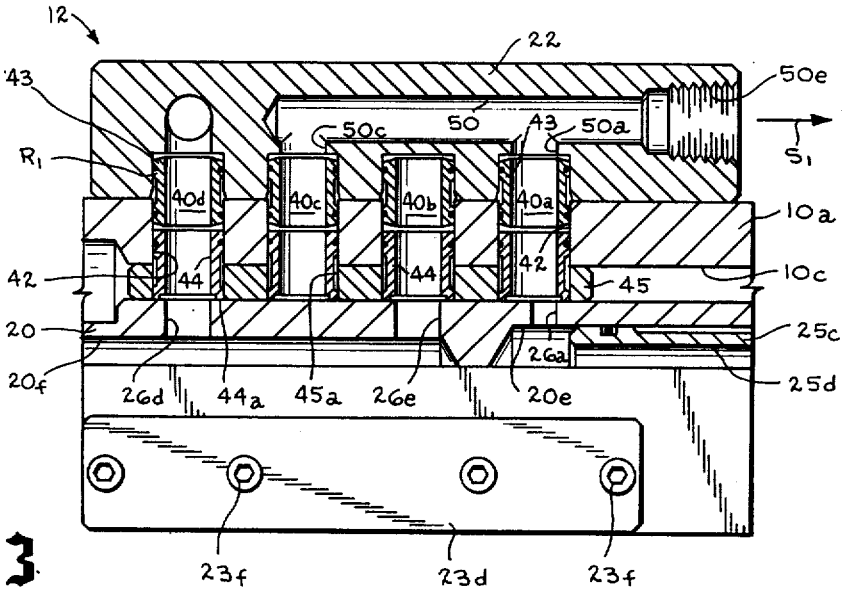
FIG. 3 is a sectional view taken along line 3—3 of FIG. 2 illustrating in particular one of the rows of connector ports utilized herein.
Figure 4:
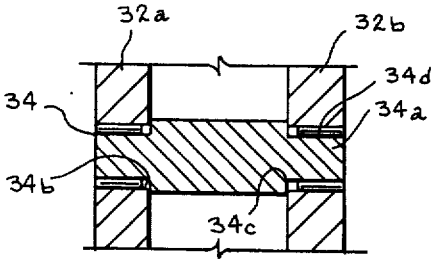
FIG. 4 is a sectional view taken along line 4—4 of FIG. 1 illustrating the structural details of a support axle.

In the initial or first position for the gate member 20 illustrated in FIG. 1, the pressure level of the fluid input signal I is herewith defined as being at a first pressure. The position of the gate member 20 at this first pressure is illustrated in FIG. 1 and FIG. 3. The gate member 20 is held in this first position by the position return spring 37 and further by the resilient engagement of the cam follower 30*c* against detent shoulder 31*d* on the detent side, which is in continual engagement with the gate member 20. In the first position for the gate member 20 in response to the first pressure of the fluid input signal I, signal ports 26*a* and 26*b* are aligned with connector ports 40*a* and 41*a* and with vertical bore portion 50*a* and 41*a*, respectively. However, since vertical bore portion 51*a* is closed to lateral bore 51, no fluid is passed through gate member signal bore 26*b* into the lateral bore 51. However, in this first position for the actuator member 20, signal bore 26*a* is aligned with connector port 40*a* in row R1; therefore, the fluid providing first input signal I passes through gate member bore 20*e*, signal port 26*a*, connector port 40*a*, vertical bore portion 50*a* and into lateral bore 50 and outwardly thereof to provide fluid output signal S1. In this first position, the exhaust gate member port 26*d* is aligned with connector port 40*d* in order to allow any fluid in lateral bore 52 (which provides signal S3) to exhaust through the gate member exhaust bore 20*f* and outwardly through the exhaust passages 31*c* in the detent slide 31.

Whenever desirable to provide signal S2, the pressure level of the fluid input signal is increased sufficiently to overcome the yieldable engagement of the cam follower 30*c* against shoulder 31*d* on detent slide 31. When the pressure level of the fluid input signal I is increased sufficiently, the gate member 20 and the detent slide 31 will be pushed forwardly sufficiently to cause the yieldably mounted cam follower 30*c* to become disengaged from the first detent shoulder 31*d*. The increase to the second predesignated pressure level may be temporary. For after the increase to the second, higher pressure level, the gate member 20 is moved toward the second position after the cam follower 30*c* and its engagement against shoulder 31*d* is overcome and the cam follower 30*c* is moved upwardly onto flat surface 31*d'* of the detent slide 31. Once the cam follower is on the flat surface 31*d'*, the gate member 20 will continue to move toward the second position even though there is a pressure drop due to leakage from ports 26*a* and 26*b* between the top 20*a* of the gate member 20 and the bottom surface of the flow restriction plate 45. Thus the cam follower 30*c* and its yieldable engagement against detent shoulders such as 30*d* allows the gate member 20 to be moved to the second position even though the increase to the second pressure level is temporary due to leakage. The gate member 20 will thus be moved to position two even though the pressure drops down; and in the preferred embodiment, the gate member 20 continues to move even though the pressure level drops down below the first pressure level. Thus the gate member 20 and detent slide quickly move forwardly until the cam follower engages the second detent shoulder 31*e* even though the pressure drops down below the second pressure level. The yieldable cam follower 30*c* is resiliently urged into engagement with the second detent shoulder 31*e* with sufficient force by spring 33 to cause the detent slide 31 and thus the gate member 20 to be held against further movement. Thus the increase from the first pressure level to a second predesignated pressure level (even temporarily) will cause movement of the gate member to a second position. This second position is illustrated in FIG. 5.

Referring to FIG. 5, in the second position of the gate member 20 as determined by the attainment of a second, higher pressure level of the fluid input signal I, the fluid output signal S2 is produced. With the gate member 20 in the second position, the signal bore 26*a* is aligned with vertical bore portion 50*b* in the manifold block 12*a*. As previously described, the vertical bore portion 50*b* is closed off with respect to the lateral bore 50; therefore, no fluid is passed through signal port 26*a* into lateral port 50 and thus signal S1 is not activated.

However, in the second position for the gate member 20, the signal bore 26*b* is aligned with connector port 41*b*, which is open to lateral bore 51 through vertical bore portiono 51*b* for providing signal S2. Therefore, the fluid input signal I at its second pressure level passes fluid through the gate member bore 20*e*, signal port 26*b*, connector port 41*b*, vertical bore portion 51*b* and into the lateral bore 51 thereby providing fluid output signal S2. Thus, the fluid output signal S2 is produced by the fluid input signal I at the second pressure level. At the secnd pressure level for the fluid input signal I, several exhaust functions occur along with the production of output signal S2. Fluid in bore 50 from signal S1 is exhausted through vertical bore portion 50*c* into exhaust passage 26*e* and exhaust bore 20*f* in the gate member 20. Further, any fluid in bore 52 of signal S3 may be exhausted through vertical bore portion 52*a* into exhaust passageway 26*c* and outwardly through gate member bore 20*f*.

An increase in the pressure level of the fluid input signal I to a third pressure level higher than the second pressure level causes movement of the gate member 20 and detent slide 31 forwardly to a third position. In order for such movement to occur, the presssure lelvel of the fluid input signal I must be sufficient level exert sufficient force against the end portion 20*e'* of the lateral gate member bore 20*e* to overcome the yieldable engagement of the cam follower 30 against the second detent shoulder 31*e*. The compressive resistance of the position return spring 37 engaging the detent slide 31 must also be ovrcome. When the force exerted against the gate member 20 by the fluid input signal I at the third, predesignated fluid level is sufficiently great, the cam follower 30*c* will be forced out of engagement with the second detent shoulder 31*e*. Thereafter, the gate member 20 will continue to move to the third position wherein the cam follower 30*c* engages the third detent shoulder 31*f* even though the pressure drops down from the third pressure level. Yieldable engagement of the pivotally, yieldably mounted cam follower 30*c* against the third detent shoulder 31*f* halts further movement of the detent slide 31 in the gate member 30 and maintains the gate member 30 and slide member 31 in this third position. In the third position, the signal S1+S2 is provided.

The signal S1+S2 is providied in the third gate member position in response to the predesignated third pressure level of the fluid input signal by the alignment of the signal gate member bores 26*a* and 26*b* with connector ports 40*c* and 41*c*. In the third position for the gate member 20, the signal gate member port 26*a* is aligned with the connector port 40*c*, which is mounted in the vertical bore portion 50*c*, the vertical bore portion 50*c* being open to lateral bore 50. Therefore, the fluid of fluid input signal I passes through the lateral gate member bore 20*e*, through signal gate member bore 26*a*, through connector port 40*c*, through vertical bore portion 50*c* and into the lateral bore 50 and outwardly as signal S1. However, in addition, the gate member signal port 26*b* is aligned with connector port 41*c* such that the flluid of the input signal at its third pressure level is also passed outwardly through vertical bore portion 51*c* into lateral bore 51 in the manifold block 50 thereby providing signal S2. Therefore, both signals S1 and S2 are provided at the third pressure level for the input signal I. As previously mentioned, this combined signal S1+S2 can be connected to a different ultimate function such as a different valve by suitable fluid lines such that an additional output signal S1+S2 is provided by only three single output signals.

The final output signal S3 is provided by raising the pressure level of the fluid input signal I at least temporarily to a fourth pressure level higher than the third pressure level. The fourth pressure level of the input signal I is sufficient to exert a force on the gate member signal bore end portion 20*e* sufficient to cause the detent slide 31 to overcome the yieldable resistance of the cam follower engaging detent surface 31*f* (and position return spring 37) and thus allow the detent slide 31 and gate member 30 to move to their fourth position. The fourth position is secured by engagement of the slide member 31 against the spring retainer member 38. In the fourth position, which is illustrated particularly in FIG. 6, the signal S3 is provided.

In the fourth position for the gate member 20, the signal bores 26*a* and 26*b* are aligned with connector ports 40*d* and 41*d*, respectively, such that the fluid of the fluid input signal I is passed through the signal bores 26*a* and 26*b*, through connector ports 40*d* and 41*d* and through vertical manifold block bore portions 52*b* and 52*a*, respectively, into the lateral bore 52 in order to provide output signal S3.

When the gate member 20 is in the fourth position, the input signal I is being converted into a fluid output signal S3 through fluid flow through both gate member signal input ports 26*a* and 26*b* into the manifold block bore 52 as previously described. With the gate member in the fourth position, the fluid in both lateral manifold bores 50 (S1) and 51 (S2) is being exhausted. The fluid in lateral bore 50 of the manifold block 22*a* is exhausted through vertical bore portion 50*a*, through connector port 40*a* and into chamber exhaust passage 26*f* in the gate member 20 and outwardly thereof into the signal housing section bore 10*b* and outwardly through vent port 16. Further, the gate member exhaust bore 26*g* is aligned with connector port 41*b* in vertical bore portion 51*b* such that any fluid in the manifold block bore 51 of signal S2 is vented outwardly into the signal housing section bore 10*b*, also.

The second, third and fourth pressure levels described herein may actually be termed pressure "surges" in the sense that the levels are achieved only temporarily for sufficient time to exert sufficient force to cause the detent shoulders 31 to overcome the yieldable resistance of force by the pivotally mounted cam follower 30*c*.

It should be understood that the control valve V of this invention can be utilized to operate other valves or other ultimate functions than those associated with subsea christmas trees. It is within the scope of this invention to utilize the single fluid input source I, whether remotely located or not, to provide variable output signals such as S1, S2, S1+S2 or S3 in response to changes in the pressure variation in the single fluid input signal.

It should be further understood that the number of fluid output signals derived from the fluid input signal I may be varied by varying the internal programming including the number and direction of the passageways of the manifold block 22*a*. The cam follower assembly 30 and in particular the cam follower 30*c* engages the inclined, detent surfaces 31*d*–31*f* in the slide member 31 in order to control the position of the slide member 31 and ultimately the gate member 30 in response to the intensity of the input signal I. It should be understood that the resistance of the pivotally and yieldably mounted cam follower 30, as mounted on pivot arm 30*a*, and the movement of the slide member 31 is dependent upon the angle of incline of the detent shoulders such as 31*d*. The resistance of the spring loaded cam follower to movement of the slide member is further dependent upon the pre-load and size of the detent spring 33.

In the preferred embodiment of this invention, two rows R1 and R2 of connector ports have been disclosed. However, it should be understood that only one row may be utilized or perhaps more than two rows may be utilized if desired. It is necessary to vary the location of the passageways in the gate member in order to accommodate such variations in the number of rows of connector ports; however, the principles and concepts of invention set forth herein remain intact in spite of variations in the number of rows of connector ports in the positions of passageways in the gate member.

The foregoing disclosure and description of the invention are illustrative and explanatory thereof, and various changes in the size, shape and materials as well as in the details of the illustrated construction may be made without departing from the spirit of the invention.

I claim:

1. A valve for providing various predesignated output signals in response to selected pressure levels of a fluid input signal from a remote signal source, comprising:

a housing connectable to a remote input signal source for providing a fluid input signal at selected, different pressure levels, each of which pressure levels is associated with a different valve position;

position responsive means mounted in said housing for movement from a first position to any desired position of a plurality of other positions in response to an input signal pressure level associated with said desired position;

cam means operably engaging said position responsive means for allowing movement of said position responsive means from said first position to any desired position of said plurality of other positions only in response to the selected pressure level of said plurality of different input signal pressure levels which is associated with said desired positions;

output signal means operably connected to said position responsive means for directin fluid from said signal source to form a predesignated output signal in response to the position of said position responsive means as determined by the selected pressure levels of said fluid input signal, whereby an input signal source is used to provide various predesignated output signals.

2. The structure set forth in claim 1, wherein said output signal means includes:

a manifold assembly mounted with said housing adjacent to said position responsive means for receiving fluid of said input signal from said position responsive means and directing said fluid input signal to form a predesignated output signal.

3. The structure set forth in claim 1, wherein:

said output signal means includes a manifold assembly mounted with said housing for directing outwardly different output signals;

said position responsive means includes an actuator member mounted in said housing for operative connection with said input signal source, said actuator member being slidably movable with respect to said housing and including means for directing fluid from said signal source into said manifold assembly to produce different output signals in response to different positions of said actuator member; and said cam means includes means for yieldably maintaining said actuator member in different positions as determined by the selected pressure levels of the fluid input signal.

4. The structure set forth in claim 3, including:

said actuator member having a passageway therein providing fluid communication of said fluid input signal to said manifold assembly; and said manifold assembly having output passageways therein for providing different predesignated output signals in response to the position of said actuator member.

5. The structure set forth in claim 4, wherein:

a plurality of said output passageways simultaneously provide a predesignated output signal.

6. The structure set forth in claim 1, wherein:

said position responsive means includes an actuator member mounted in said housing for movement to various signaling positions;

said cam means includes means for resiliently engaging said actuator member to maintain said actuator member in a signaling position.

7. The structure set forth in claim 6, including:

said actuator member includes staggered shoulder portions; and said cam means includes a rocker arm element mounted in said housing for pivotal movement;

resilient means yieldably urging said rocker arm element into engagement with one of said staggered shoulder portions; and said actuator member including means for receiving said fluid input signal at predesignated pressure levels for overcoming said resilient means to allow said actuator member to be moved a plurality of positions.

8. The structure of claim 6, including:

said actuator member including staggered shoulder means requiring a pressure increase to overcome said engagement by said cam means, but providing for continued movement of said actuator member at reduced pressures.

9. The structure set forth in claim 1, including:

said position responsive means includes an actuator member mounted in said housing for slidable movement between various positions in response to changes in the pressure of said fluid input signal;

said actuator member having a passageway therein in fluid communication with said fluid input signal;

said output signal means includes a manifold assembly mounted with said housing and having different selective output fluid paths therein for receiving said fluid input signal through said passageway in said actuator member; and said passageway in said actuator member being aligned with said different selective output fluid paths of said manifold assembly in response to changes in the pressure level of such fluid input signal acting on said actuator member whereby the pressure level of said fluid input signal determines the fluid output signal.

10. The structure set forth in claim 1, including:

said output signal means includes a manifold assembly having first, second and third output flow paths; and said position responsive means includes a gate member mounted in said housing for slidable movement from said first position to second, third and fourth positions, depending upon the pressure level of such fluid input signal, said gate member having passageways therein for providing fluid communication of fluid from said signal source to one or more of said first, second and third output flow paths.

11. The structure set forth in claim 10, including:

said gate member being movable to said first position in response to a first pressure level of said fluid input signal, one of said passageways in said gate member in said first position providing fluid communication between such fluid input signal at said first pressure level and said first output flow path of said manifold assembly thereby providing a first output signal.

12. The structure set forth in claim 11, including:

said gate member being movable to said second position in response to a second pressure level of said fluid input signal, said second pressure level being higher than said first pressure level, one of said passageways in said gate member in said second position providing fluid communication between said fluid input signal at said second pressure level and said second output flow path thereby providing a second output signal in response to an increase in the pressure of such fluid input signal from said first to said second level.

13. The structure set forth in claim 12, including:

said gate member being movable to said third position in response to an increase in the pressure of said fluid input signal to a third pressure level higher than said second pressure level, said passageways in said gate member in said third position being in fluid communication with said first and second output flow paths to provide a third output signal.

14. The structure set forth in claim 13, including:

said gate member being movable to said fourth position in response to an increase in the pressure of said fluid input signal to a fourth pressure level, said passageways in said gate member being in fluid communication with said third output flow path in said manifold assembly thereby providing a fourth output signal.

15. The structure set forth in claim 1, wherein:

said cam means includes means for allowing movement of said position responsive means from said first position to said other positions in response to temporary pressure levels of said input fluid signal.

16. The structure set forth in claim 1, including:

said position responsive means includes means providing continuous movement to positions in response to a temporary increase and then a decrease in the pressure of said fluid input signal.

* * * * *